US008522736B2

(12) United States Patent
Niiro

(10) Patent No.: US 8,522,736 B2
(45) **Date of Patent: *Sep. 3, 2013**

(54) PHASE VARIABLE DEVICE FOR ENGINE

(75) Inventor: Masaaki Niiro, Hadano (JP)

(73) Assignee: Nittan Valve Co., Ltd., Hadamo-shi (JP)

( * ) Notice: Subject to any disclaimer, the term of this patent is extended or adjusted under 35 U.S.C. 154(b) by 54 days.

This patent is subject to a terminal disclaimer.

(21) Appl. No.: 13/255,728

(22) PCT Filed: Mar. 31, 2009

(86) PCT No.: PCT/JP2009/056700

§ 371 (c)(1),
(2), (4) Date: Nov. 3, 2011

(87) PCT Pub. No.: WO2010/113279

PCT Pub. Date: Oct. 7, 2010

(65) Prior Publication Data

US 2012/0090567 A1 Apr. 19, 2012

(51) Int. Cl.
*F01L 1/34* (2006.01)

(52) U.S. Cl.
USPC ..... 123/90.17

(58) Field of Classification Search
USPC ..... 123/90.15, 90.17; 464/160, 161; 74/567

See application file for complete search history.

(56) References Cited

U.S. PATENT DOCUMENTS

| | | | | |
|---|---|---|---|---|
| 8,286,602 | B2 * | 10/2012 | Kameda et al. | 123/90.17 |
| 8,322,319 | B2 * | 12/2012 | Nagado | 123/90.17 |
| 2008/0202460 | A1 | 8/2008 | Maehara et al. | |
| 2008/0308053 | A1 | 12/2008 | Tsuchida | |
| 2011/0036319 | A1 * | 2/2011 | Kameda et al. | 123/90.17 |
| 2012/0247912 | A1 * | 10/2012 | Niiro | 192/12 D |

FOREIGN PATENT DOCUMENTS

| | | | |
|---|---|---|---|
| JP | 2644408 | B1 | 8/1997 |
| JP | 10-266876 | A | 10/1998 |
| JP | 2001-41013 | A | 2/2001 |
| JP | 2008-208731 | A | 9/2008 |
| WO | 2006/025174 | A1 | 3/2006 |

OTHER PUBLICATIONS

International Search Report dated Jun. 16, 2009 for PCT/JP2009/056700.

* cited by examiner

*Primary Examiner* — Thomas Denion
*Assistant Examiner* — Daniel Bernstein
(74) *Attorney, Agent, or Firm* — Westerman, Hattori, Daniels & Adrian, LLP

(57) ABSTRACT

OBJECT: To provide a compact phase varying device for an automobile engine, adapted to vary the relative phase angle between the crankshaft of the engine and the camshaft of the device over a wider range than that of conventional device.

MEANS FOR ACHIEVING THE OBJECT:

The phase varying device has: a drive rotor driven by the crankshaft of the engine; a first control rotor rotatable relative to the drive rotor under the action of a torque means; and a phase angle varying mechanism operably coupled to the first control rotor in rotational motion relative to the first control rotor, the drive rotor and first control rotor rotatably supported by a camshaft of the phase varying apparatus, the phase varying device adapted to vary the phase angle of the camshaft relative to the crankshaft by varying the phase angle of the camshaft relative to the drive rotor. The phase angle varying mechanism is characterized by comprising:

- a first circular eccentric cam integrated with the first control rotor and having a center eccentrically offset from the rotational axis of the camshaft;
- a second circular eccentric cam integrated with the camshaft and having a center eccentrically offset from the rotational axis of the camshaft;
- a cam guide member for rotatably coupling the first circular eccentric cams with the second circular eccentric cam and for converting the eccentric rotational motion of the first circular eccentric cam into the eccentric rotational motion of the second circular eccentric cam.

4 Claims, 10 Drawing Sheets

(a)

(b)

(a)

(b)

(a)

(b)

PHASE VARIABLE DEVICE FOR ENGINE

FIELD OF THE INVENTION

The present invention relates to a phase varying device for an automobile engine having a mechanism for varying valve timing of the engine by advancing or retarding the phase angle of a camshaft relative to the crankshaft of the engine, the mechanism utilizing circular eccentric cams.

BACKGROUND ART

A similar device in the form of a valve timing control device has been disclosed in Patent Document 1 cited below. As disclosed in Patent Document 1 this device has a drive rotor 2 driven by a crankshaft (not shown) and a guide plate 27 (which corresponds to a first control rotor of the present invention) rotatable relative to the drive rotor 2. The camshaft 1 of the device has a lever member 18 which is integral with the camshaft 1 and rotatably coupled at one end thereof to one end of a pair of link arms (16*a* and 16*b*) with a pin 25. The other end of the link arm (16*a* and 16*b*) are rotatably connected to the front ends of operative members (14*a* and 14*b*) by means of pins 24. The operative members are provided on the front ends thereof with protrusions 26 that engage with spiral guides 32 formed in the rear end of a guide plate 27. The rear ends of the operative members (14*a* and 14*b*) are configured to engage guide grooves (11*a* and 11*b*) which extend substantially in the radial direction (the grooves hereinafter referred to as radial guide grooves.)

When the guide plate 27 is attracted by an electric magnet 29, the guide plate 27 is retarded in rotation relative to the drive rotor 2. Then, the protrusions 26 of the front ends of the operative members (14*a* and 14*b*) are displaced in the spiral guides 32, while the rear ends are displaced along the radial guide grooves (11*a* and 11*b*) in the radially inward direction of the drive rotor 2. In this case, the link arms (16*a* and 16*b*) are rotated about the pin 25 relative to the lever member 18 in the clockwise direction (as viewed from the guide plate 27). As a consequence, the phase angle of the camshaft 1 relative to the drive rotor 2 (that is, the relative phase angle between the crankshaft and the camshaft) is advanced in the direction R as shown in FIG. 4 (the direction referred to as phase angle advancing direction), thereby varying the valve timing of the valves.

PRIOR ART DOCUMENT

PATENT DOCUMENT JPA H2001-041013

DISCLOSURE OF THE INVENTION

Problems to be Solved by the Invention

To allow valve timing to change over a wide range, it is preferable to make the variable range of the phase angle of the camshaft 1 relative to the drive rotor 2 as large as possible. In the device of Patent Document 1, the maximum range of the phase angle variation can be extended by making the length of the link arms (16*a* and 16*b*) longer and making the outer diameters of the drive rotor 2 and guide plate 27 larger. However, such modifications will disadvantageously make the phase varying device larger. On the other hand, the space available for the phase-varying apparatus is limited in the engine.

If in the device of Patent Document 1 accuracy of the connection of the link arms (16*a* and 16*b*) and pins (24 and 25) has a low accuracy, and accuracy of the engagement of the operative members (14*a* and 14*b*) with the spiral guides 32 has a low precision, it may happen that the link arms (16*a* and 16*b*) cannot smoothly rotate relative to the lever members 18, which may prevent the operative members (14*a* and 14*b*) from undergoing smooth movement in the spiral guides 32. Manufacturing these elements with a high degree of accuracy will entail disadvantageously high production cost.

In view of such prior art problem, the present invention is directed to an improved phase varying device for an automobile engine which has a larger variable range in phase angle than conventional devices, yet it is compact in size and can be easily manufactured.

Means for Solving the Problems

There is provided in accordance with the present invention a phase varying device for use with an automobile engine, having a drive rotor driven by the crankshaft of the engine; a first control rotor rotatable relative to the drive rotor under the action of a torque means; and a phase angle varying mechanism operably coupled to the first control rotor in rotational motion relative to the first control rotor, the drive rotor and first control rotor rotatably supported by a camshaft of the phase varying apparatus, the phase varying device adapted to vary the phase angle of the camshaft relative to the crankshaft by varying the phase angle of the camshaft relative to the drive rotor, the phase angle varying mechanism characterized by comprising:

a first circular eccentric cam integrated with the first control rotor and having a center eccentrically offset from the rotational axis of the camshaft;

a second circular eccentric cam integrated with the camshaft and having a center eccentrically offset from the rotational axis of the camshaft;

a cam guide member for rotatably coupling the first circular eccentric cams with the second circular eccentric cam and for converting the eccentric rotational motion of the first circular eccentric cam into the eccentric rotational motion of the second circular eccentric cam, thereby varying the phase angle of the camshaft relative to the drive rotor in accord with the eccentric rotational motion of the second circular eccentric cam relative to the first circular eccentric cam.

(Function) Under the action of the torque means, the first control rotor is rotated relative to the drive rotor in either the phase advancing direction (rotational direction of the drive rotor driven by the crankshaft) or the phase retarding direction (direction opposite to the phase advancing direction). The first circular eccentric cam rotates eccentrically about the rotational axis of the camshaft together with the first control rotor. The eccentric rotation of the first circular eccentric cam is converted into the eccentric rotation of the second circular eccentric cam by the cam guide member. Since the camshaft rotates together with the second circular eccentric cam relative to the drive rotor, its phase angle relative to the drive rotor (or crankshaft) is altered.

The phase angle of the camshaft relative to the drive rotor is greatly changed in proportion to the distance traveled by the central axis of the second circular eccentric cam during the change. Thus, the variable range of the phase angle of the camshaft relative to the drive rotor (or crankshaft) may be further extended, without making the outer diameters of the first and second circular eccentric cams larger, by increasing the degree of eccentricity of the second circular eccentric cam (that is, making longer the distance between the rotational axis of the camshaft and the center axis of the circular eccentric cam).

It is noted that the phase angle of the camshaft relative to the drive rotor is smoothly altered by the eccentric rotations of the first and second circular eccentric cams via the cam guide member if the drive rotor is not very accurately mounted on the drive rotor.

As defined in claim 2, the phase varying device of claim 1 may be configured in such a way that the drive rotor is provided with radial guide grooves that extend in substantially radial directions perpendicular to the rotational axis of the camshaft; and the cam guide member is provided with a pair of grip sections penetrating the radial guide grooves to grip the outer circumference of the first circular eccentric cam by the opposite sides, the grip sections movable in the radial guide grooves in response to the eccentric rotational motion of the first circular eccentric cam; and an oblong circular hole extending in the direction perpendicular to the radial guide grooves and slidably accommodating therein the second circular eccentric cam so as to displace the second circular eccentric cam in the direction perpendicular to the radial guide grooves.

(Function) The cam guide member reciprocates in the direction perpendicular to the rotational axis of the camshaft due to the fact that the grip sections in engagement with the radial guide grooves of the drive rotor moves in the guide grooves in response to the eccentric rotation of the first circular eccentric cam inside the oblong hole. Since the oblong hole extends in the direction perpendicular to the radial guide grooves, the reciprocating cam guide member 33 causes the second circular eccentric cam, slidably held in the oblong hole, to rotate eccentrically.

The first circular eccentric cam, cam guide member, and second circular eccentric cam are arranged so that the paired first and second circular eccentric cams can slidably move on the inner walls of the grip sections and oblong hole. In this arrangement, the phase angle of the camshaft relative to the drive rotor can be smoothly changed since the paired cams can undergo smooth relative motions if the cams and the cam guide member are not formed with high precision.

The initial change in the phase angle of the camshaft relative to the drive rotor can be set to occur in either the phase advancing direction or phase retarding direction. This can be done by setting the initial angular positions of the axes of the first and second circular eccentric cams angularly offset in either the same direction with respect to the radial guide grooves of the drive rotor or the opposite directions across the guide grooves. In other words, if the center axes of the first and second circular eccentric cams are inclined in the same direction with respect to the radial guide grooves of the drive rotor, the second circular eccentric cam is eccentrically rotated in the same direction as the first circular eccentric cam, but rotated in the direction opposite to that of the first circular eccentric cam if they are inclined initially in the opposite directions with respect to the guide grooves. Thus, the direction of the initial change in phase angle from the initial angular position can be easily switched from the phase retarding direction to the phase advancing direction by simply changing the initial angular position of the center axis of the second circular eccentric cam.

As defined in claim 3, the phase varying device of claim 1 or claim 2 may be configured in such a way that the torque means comprises:

a first control means for rotating the first control rotor in the phase retarding direction relative to the drive rotor (the direction being opposite to the rotational direction of the drive rotor rotated by the crankshaft); and a reverse mechanism for rotating the first control rotor in the phase advancing direction relative to the drive rotor (the direction being the same as that of the drive rotor driven by the crankshaft).

(Function) The first control means alters the phase angle of the camshaft relative to the drive rotor (or crankshaft) either in the phase advancing direction or phase retarding direction, while the reverse mechanism alters the phase angle in the opposite direction.

As defined in claim 4, the phase varying device of claim 3 may be further configured in such a way that the reverse mechanism comprises:

a second control rotor arranged rotatable relative to the camshaft;

a second brake means for putting a brake on the second control rotor so as to rotate the second control rotor in the phase retarding direction relative to the first control rotor; and a ring mechanism for rotating the first control rotor in the phase advancing direction relative to the drive rotor when the second braking means is in operation, and wherein the ring mechanism includes a first ring member in sliding contact with a first circular eccentric hole formed in the first control rotor;

a second ring member in sliding contact with a second circular eccentric hole formed in the second control rotor;

an intermediate rotor having a radial guide groove and being rotatable together with the camshaft; and an eccentric coupling member passing through the radial guide groove of the intermediate rotor and movable in the radial guide groove, the eccentric coupling member having opposite ends rotatably coupled to the first and second ring members, respectively, to allow for relative eccentric rotations of the first and second ring members.

(Function) The second control rotor rotates the first control rotor in the phase advancing direction relative to the drive rotor via the ring mechanism in the manner as described below. As the second brake means puts a brake on the second control rotor, the second circular eccentric hole of the second control rotor eccentrically rotates about the center axis of the camshaft. In response to the eccentric rotational motion of the second eccentric hole, the second ring member rotates and reciprocates in the second circular eccentric hole, thereby displacing the eccentric coupling member in the radial guide groove of the intermediate rotor. The first ring member rotates and reciprocates in the first circular eccentric hole by the displacement of the eccentric coupling member. Through the rotation motion of the first ring member, the first control rotor is subjected to a torque which causes the first control rotor to be rotated in the phase advancing direction relative to the drive rotor.

Results of the Invention

According to the claimed inventions, a compact phase varying device may be obtained which has a wide range of variable phase angle for a camshaft relative to the crankshaft.

Although the phase varying mechanism for varying the phase angle between the camshaft and the drive rotor includes a multiplicity of circular eccentric cams, the mechanism has less elements and simpler structure than conventional devices. Thus, the accuracy of the mechanism can be easily achieved. Accordingly, the inventive phase varying device can operate more smoothly than those conventional devices utilizing link arm mechanisms and/or spiral guide grooves. Further, the inventive phase varying device can be easily manufactured at low cost.

It is noted that since the inventive mechanism is simpler in structure and has less elements, the mechanism operates smoothly if it did not have a higher accuracy than conventional mechanism that utilize link arms and/or spiral guide grooves. As a result, the phase varying device of the invention can be easily manufactured at low cost.

BRIEF DESCRIPTION OF THE DRAWINGS

FIG. 1(*b*) a cross section of a second circular eccentric cam, taken along Line B-B of FIG. 3, illustrating an arrangement of the second circular eccentric cam in the phase retarding mode.

NOTATIONS

Figure 1:
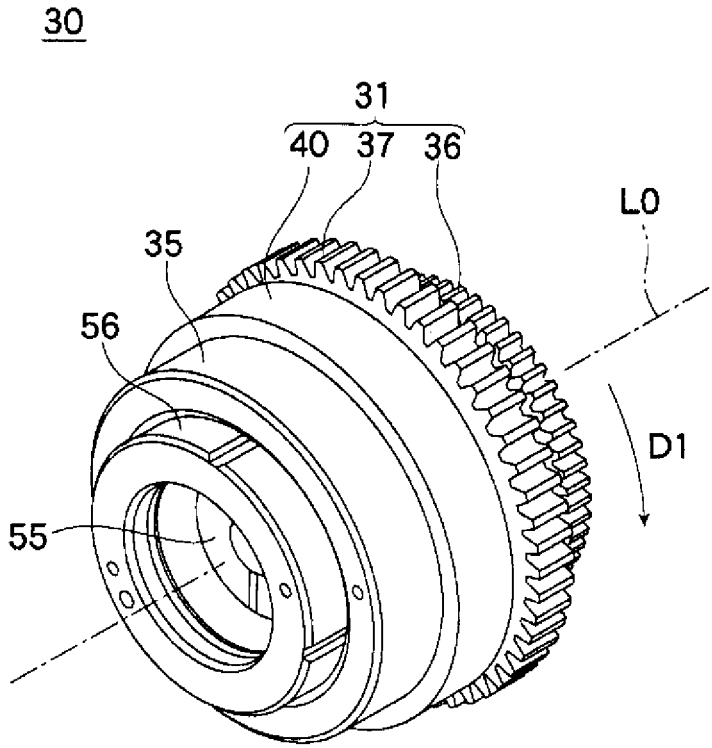
FIG. 1 is a perspective view of a phase varying device for automobile engine in accordance with a first embodiment of the invention.

30 phase varying device for automobile engine
31 drive rotor
33 cam guide member
34 first control rotor
34*f* first circular eccentric hole
35 first electromagnetic clutch (first brake means)
36-37 sprockets
40 drive cylinder
41 first circular eccentric cam
45 camshaft
46 second circular eccentric cam
47 radial guide grooves of drive rotor
48 grip sections of cam guide member
49 oblong hole of cam guide member
50 first ring member
51 intermediate rotor
52 movable coupling member
53 second ring member
54 second control rotor
54*c* second circular eccentric hole
56 second brake means
57 and 62 reverse mechanism
59 torsion coil spring (reverse mechanism)
60 control rotor
61 drive disc
65 phase angle varying mechanism
66 torque means
67 ring mechanism
L0 rotational axis of camshaft
L3 direction of radial guide groove of drive cylinder
L4 direction of major axis of oblong hole

BEST MODE FOR CARRYING OUT THE INVENTION

The invention will now be described in detail by way of example (first through third embodiments) with reference to the accompanying drawings.

Each of the phase varying device in accordance with the first through third embodiments of the invention is mounted in an automobile engine. The device is adapted to not only transmit the rotational motion of the crankshaft of the engine to a camshaft so that the intake valves/exhaust valves of the engine are opened/closed in synchronism with the rotational motion of the crankshaft, but also vary the valve timing of the intake valves/exhaust valves in accord with the load and/or rpm of the engine.

Figure 2:
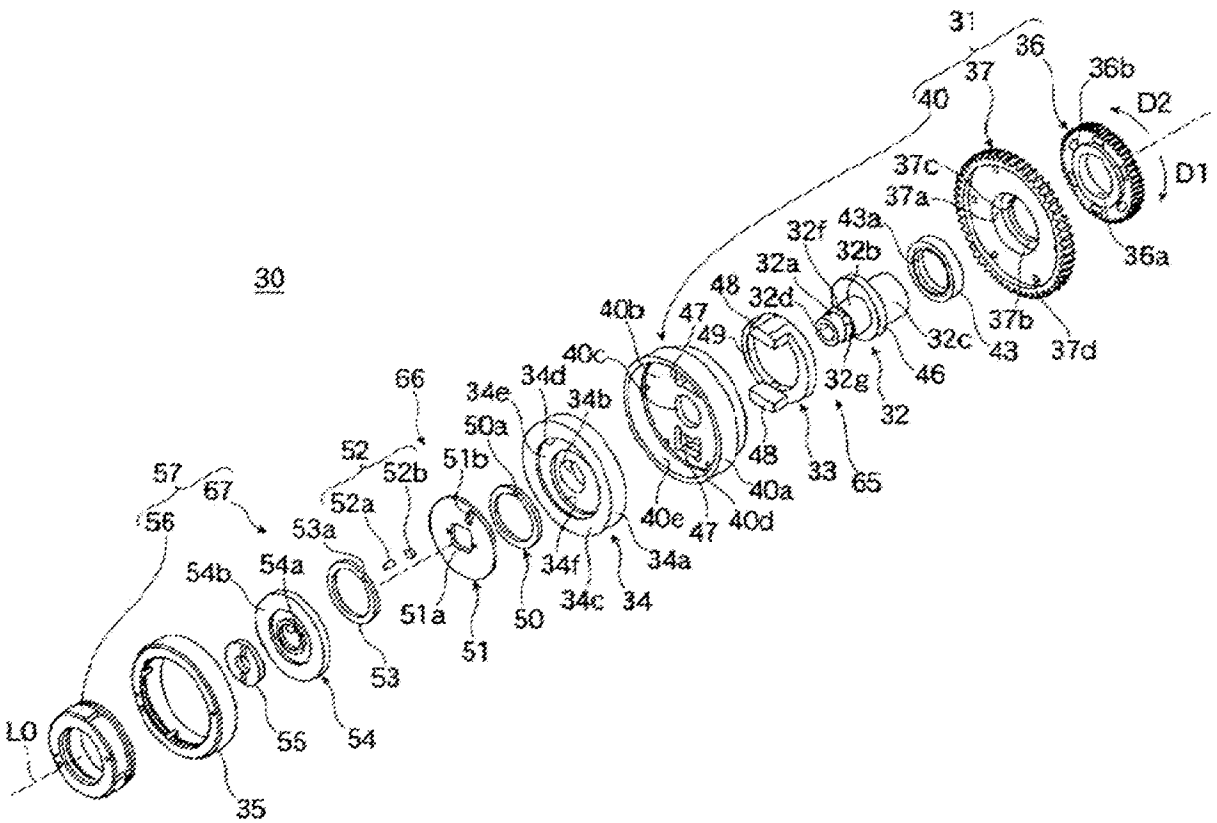
FIG. 2 is an exploded perspective view of the device shown in FIG. 1.

The first embodiment will be described in detail below with reference to FIGS. 1 though 8. A phase varying device 30 of the first embodiment for automobile engine consists of a drive rotor 31, center shaft 32, phase angle varying mechanism 65, and torque means 66, all arranged coaxial with a rotational axis L0. The phase angle varying mechanism 65 consists of a first circular eccentric cam 41, cam guide member 33, and second circular eccentric cam 46. The torque means 66 consists of a first electromagnetic clutch 35 and a reverse mechanism 57. In what follows the term "front end" of the device refers to the end of the device where a second electromagnetic clutch 56 is provided as shown in FIG. 2, and "rear end" refers to the other end where sprockets 36 is provided. The clockwise direction of rotation of the drive rotor 31 as viewed from the front end will be referred to as direction D1 or phase advancing direction, while the counterclockwise direction will be referred to as direction D2 or phase retarding direction.

It is now supposed that under the initial condition the center shaft 32, cam guide member 33, and first control rotor 34 are in rotation together with the drive rotor 31 driven by the crankshaft (not shown) in direction D1 about the rotational axis L0.

The drive rotor 31 consists of two sprockets (36, 37) and a drive cylinder 40. Formed at the centers of the sprockets 36 and 37 are circular holes 36*a* and 37*a*, respectively. Provided inside and near the rear open end of the circular hole 37*a* is an inner flange 37*b*. Reference numeral 37*c* indicates a circular hole formed on the inside of the inner flange 37*b*, in which a multiplicity of disc springs 42 are coaxially stacked in the axial direction L0. Each of the disc spring 42 has a circular hole 42*a*. Fitted from front into the circular hole 37*a* is a holder 43 having at the center thereof a circular hole 43*a*.

Figure 4:
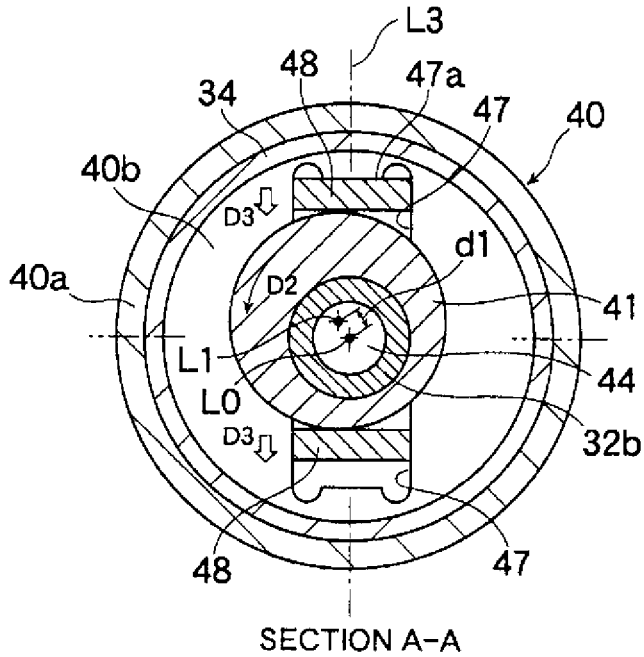
FIG. 4 shows radial cross sections of the phase varying device of the first embodiment, set in the phase retarding mode. More particularly, FIG. 1(*a*) shows a cross section, taken along Line A-A of FIG. 3, illustrating an arrangement of the first circular eccentric cam.
Figure 4:
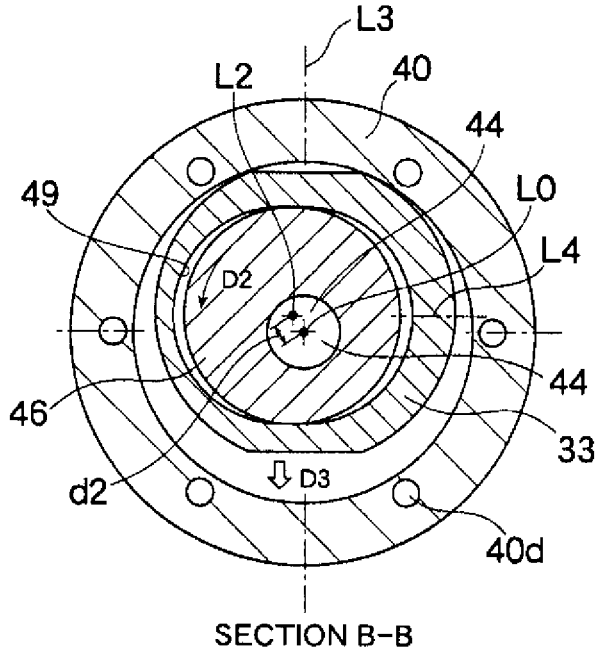

On the other hand, the drive cylinder 40 is an integral body that includes a circular cylindrical section 40*a* and a bottom section 40*b*. Formed in the bottom section 40*b* are a circular hole 40*c* and a pair of guide grooves 47 extending in substantially radial directions (the grooves referred to as radial guide grooves). The circular hole 40*c* is located at the center of the bottom section 40*b*, and a middle cylinder 32*b* of the center shaft 32 is passed through the hole as described in detail below. The paired radial guide grooves 47 are symmetrically arranged across the circular hole 40*c*. In what follows a phantom extension line passing through the rotational axis L0 of the drive cylinder 40 and extending along the radial grooves 47 will be referred to as extension line L3 (FIG. 4).

The sprocket 36 is integrated with the sprocket 37 by means of coupling pins 38 inserted in a multiplicity of pin holes 36*b*. The sprocket 37 is then integrated with the drive cylinder 40 by means of coupling pins 39 inserted in a multiplicity of pin holes 37*d* formed in the sprocket 37 and pin holes 40*d* formed in the drive cylinder 40.

Thus, the center shaft 32 comprises a sequence of a small cylinder 32*a* followed by the middle cylinder 32*b*, second circular eccentric cam 46, and a large cylinder 32*c* arranged along the rotational axis L0. The outer diameter of the large cylinder 32*c* is substantially the same as the inner diameters of the circular holes 36*a*, 42*a*, and 43*a*. The second circular eccentric cam 46 has a center axis center axis L2 offset from the rotational axis L0 of the center shaft 32 by a distance d2, and eccentrically rotates about the L0 together with the center shaft 32.

By inserting the drive rotor 31 in the circular hole 36*a*, 42*a*, and circular hole 43*a* of the center shaft 32, the drive rotor 31 is rotatably supported by the center shaft 32. The center shaft 32 is provided at the center thereof with a bolt insertion hole 32*d* and at the rear end with a coupling hole 32*e*. There is provided a camshaft 45 having a cylindrical section 45*a* at the leading end thereof and a flange section 45*b* contiguous with the cylindrical section 45*a*. By inserting the cylindrical section 45*a* of the camshaft 45 into the coupling hole 32*e* with the drive rotor 31 supported by the large cylinder 32*c*, the center shaft 32 is coupled to the camshaft 45, and is securely fixed to the camshaft 45 by tightening bolts 44 inserted in the threaded sections (not shown) of the camshaft 45 through the bolt insertion hole 32*d* from front. The drive rotor 31 is arranged between the second circular eccentric cam 46 and flange section 45*b* of the camshaft 45, and is rotatable about the center axis L0 relative to the camshaft 45.

On the other hand, the cam guide member 33 has a pair of grip sections 48 and an oblong hole 49. The paired grip sections 48 are formed across the rotational axis L0 to project forward from the front end of the outer circumference of the cam guide member 33. Further, the grip sections 48 have substantially the same width as those of the radial grooves 47 of the drive cylinder 40, and are spaced apart from each other by the same distance as that of the radial grooves 47. The oblong hole 49 is oblong in the direction L4 perpendicular to the line that connects the grip sections 48 (FIG. 4(*b*)). The oblong hole 49 receives the second circular eccentric cam 46 such that the upper and lower end of the outer circumferential surface of the 46 is in sliding contact with the inner circumferential surface of the oblong hole 49.

The cam guide member 33 is arranged between the sprocket 37 and the drive cylinder 40 and is supported by the center shaft 32 via the second circular eccentric cam 46 inserted in the oblong hole 49. The grip sections 48 are engaged with the radial grooves 47, with the leading ends of the grip sections 48 projecting forward from the radial grooves 47. As the second circular eccentric cam 46 undergoes an eccentric rotation, the grip sections 48 are moved in the radial grooves 47 and in radial directions of the drive cylinder 40.

The first control rotor 34 has a circular form having an outer diameter substantially the same as the inner diameter of the inner circumference 40*e* of the cylinder 40 so that the first control rotor 34 can be fitted in the circular cylindrical section 40*a* of the cylinder 40. The first control rotor 34 is rotatable about the rotational axis L0 relative to the drive cylinder 40 with its outer circumferential surface 34*a* supported in the inner circumferential surface 40*e* of the cylinder 40*e*. The first control rotor 34 is provided with a circular hole 34*b* for passing therethrough the middle cylinder 32*b* of the center shaft 32 and the first circular eccentric cam 41.

The first circular eccentric cam 41 is formed on the rear face of the first control rotor 34 to project rearward therefrom. The first circular eccentric cam 41 has a enter axis L1 (eccentric center) which is offset from the center axis L0 of the first control rotor 34 by a distance d1, whereby the first circular eccentric cam 41 eccentrically rotates about the rotational axis L0 together with the first control rotor 34. The first circular eccentric cam 41 is gripped by the grip sections 48 projecting from the radial guide grooves 47, in slidable contact with the radially inner surface of the grip sections 48.

Under the initial condition (prior to any phase change), the eccentric center of the first circular eccentric cam 41 (or the center axis L1 of the cam) is located at an inclined position angularly offset from the upward extension line L3 in the counterclockwise direction D2, as shown in FIG. 4. The grip sections 48 of the cam guide member 33 are arranged in the respective radial grooves 47 such that, in the example shown herein, the upper one is in slidable contact with a stopper 47*a* formed at the upper end of the upper radial groove 47.

Figure 6:
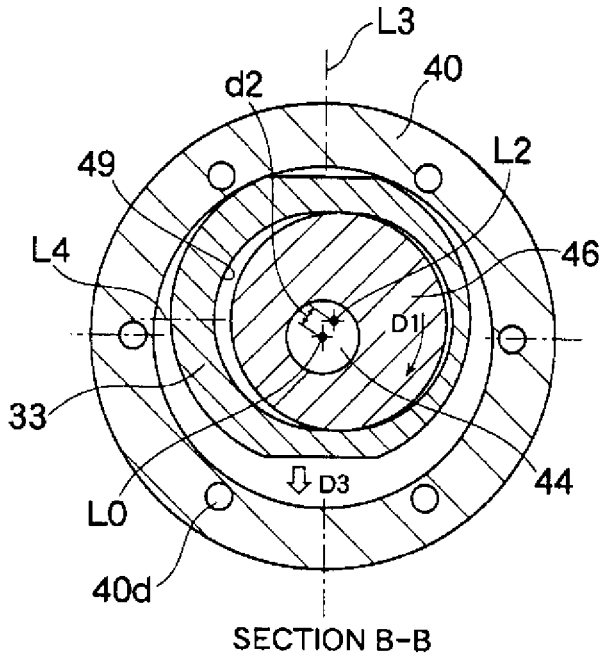
FIG. 6 shows cross sections, taken along Line B-B of FIG. 3, of the second circular eccentric cam set in the phase advancing mode under a given initial condition (FIG. 6(*a*)) and the cross section having a certain change in phase angle (FIG. 6(*b*)).
Figure 6:
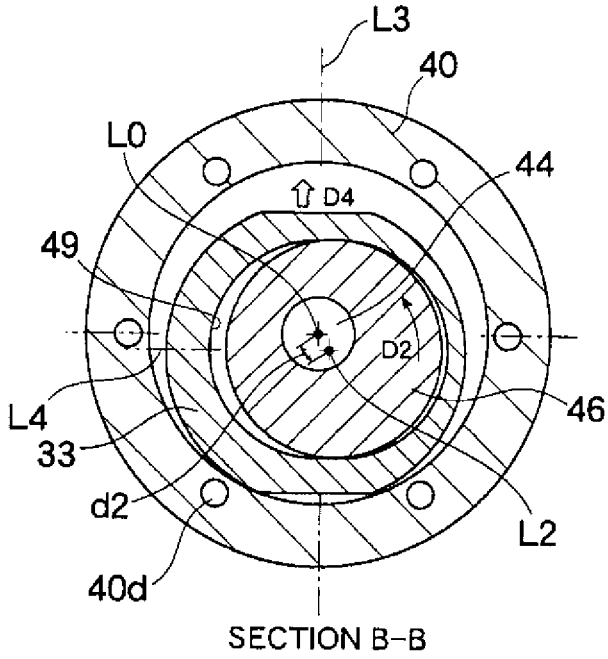

On the other hand, the eccentric center (center axis L2) of the second circular eccentric cam 46 is initially located at a position which is either angularly offset in the counterclockwise direction D2 with respect to the upward extension line L3, just like the center axis L1 of the first circular eccentric cam 41 (FIG. 4(*b*), or alternatively in the clockwise direction D1 unlike the center axis L1 (FIG. 6(*a*)).

If the center axis L2 of the second circular eccentric cam 46 is angularly offset in the direction D2 with respect to the upward extension line L3 like the center axis L1 as shown in FIG. 4(*b*), the phase angle of the camshaft 45 is altered from its initial phase angle in the phase retarding direction D2 relative to the drive rotor 31. But if the center axis L2 is offset in the opposite direction (that is, phase advancing direction D1) with respect to the upward extension line L3 as shown in FIG. 6(*a*), the phase angle of the camshaft 45 is altered from its initial phase angle in the phase advancing direction D1. (In what follows an initial arrangement of the center axis L2 inclined in the same direction as the center axis L1 will be referred to as phase retarding mode, while the arrangement of the center axis L2 inclined in the direction opposite to the center axis L1 referred to as phase advancing mode.) Thus, in the embodiments shown herein, the phase retarding mode and phase advancing mode can be switched over by simply changing the initial angular positions of the first circular eccentric cam 41 and second circular eccentric cam 46, or changing the inclination of the center axis L2 relative to the extension line L3.

The first electromagnetic clutch 35 and reverse mechanism 57 are arranged ahead of the first control rotor 34. The first electromagnetic clutch 35 is securely fixed to the engine casing (not shown), facing the front face (or contact face 34*c*) of the first control rotor 34. When a coil 35*a* is energized, the first electromagnetic clutch 35 will attract and bring the contact face 34*c* of the first control rotor 34 in rotation with the drive rotor 31 into sliding contact with the friction member 35*b*.

While the contact face 34*c* is in sliding contact with the friction member 35*b*, the first control rotor 34 is retarded with respect to the drive rotor 31, that is, the first control rotor 34 is rotated in the phase advancing direction D2 relative to the drive rotor 31 (FIGS. 2 and 4). On the other hand, when the reverse mechanism 57 is enabled in the manner described below, the first control rotor 34 is rotated in the phase advancing direction D1, which is the opposite rotational direction as compared with that brought by the first electromagnetic clutch 35.

The reverse mechanism 57 comprises a second control rotor 54, a ring mechanism 67, and the second electromagnetic clutch 56. The ring mechanism 67 comprises, in addition to the second control rotor 54, a first ring member 50 disposed in the stepped circular hole 34*d* formed in the front end of the first control rotor 34, an intermediate rotor 51, a movable member 52, and a second ring member 53 disposed in the circular stepped hole 54*c* formed in the rear end of the second control rotor 54.

The first control rotor 34 has in the front end thereof the stepped circular hole 34*d*. Formed in the bottom section 34*e* of the stepped circular hole 34*d* is a stepped first circular eccentric hole 34*f*. The first circular eccentric hole 34*f* has a center O1 offset from the rotational axis L0 of the center shaft 32 by a distance d3. The first ring member 50 has an outer diameter which is substantially equal to the inner diameter of the first circular eccentric hole 34*f*, and is slidably engaged with the first inner circumference of the first circular eccentric hole 34*f*. The first ring member 50 is formed with a first engagement hole 50*a* that is open in the forward direction.

The intermediate rotor 51 is provided at the center thereof with a square hole 51*a*, and outside the square hole 51*a* with a guide groove 51*b* extending in a substantially radial direction (the groove referred to as radial guide groove). A phantom line that extends through the rotational axis L0 of the intermediate rotor 51 and along the radial grooves 51*b* will be referred to as extension line L5. The intermediate rotor 51 is unrotatably fixed to the center shaft 32 by fitting the flat engaging faces 32*f* and 32*g* of the center shaft 32 in the square hole 51*a*.

The second control rotor 54 has a central circular hole 54*a* and a second circular eccentric bore 54*c* formed in the rear end of the control rotor 54. The second control rotor 54 is rotatably mounted on the center shaft 32 via the small cylinder 32*a* inserted in the circular hole 54*a*. The second circular eccentric bore 54*c* is eccentrically offset from the rotational axis L0 by a distance d4, like the center O2 of the second circular eccentric bore 54*c*. The second ring member 53 has an outer diameter which is substantially the same as the inner diameter of the second circular eccentric bore 54*c*, and slidably engaged in the second circular eccentric bore 54*c*. The second ring member 53 is provided in the rear end thereof with a second engagement bore 53*a*. The first and second ring members 50 and 53, respectively, are arranged such that their centers O1 and O2 are located on the opposite sides of the extension line L5.

The movable member 52 consists of a central thin cylindrical shaft 52*a* coaxially inserted in a thick hollow cylindrical shaft 52*b*. The opposite ends of the thin cylindrical shaft 52*a* are slidably engaged with the first and second engagement holes 50*a* and 53*a* of the first and second ring members 50 and 53, respectively, to couple them together. The thick hollow cylindrical shaft 52*b* is movable in the radial grooves 51*b*.

Figure 3:
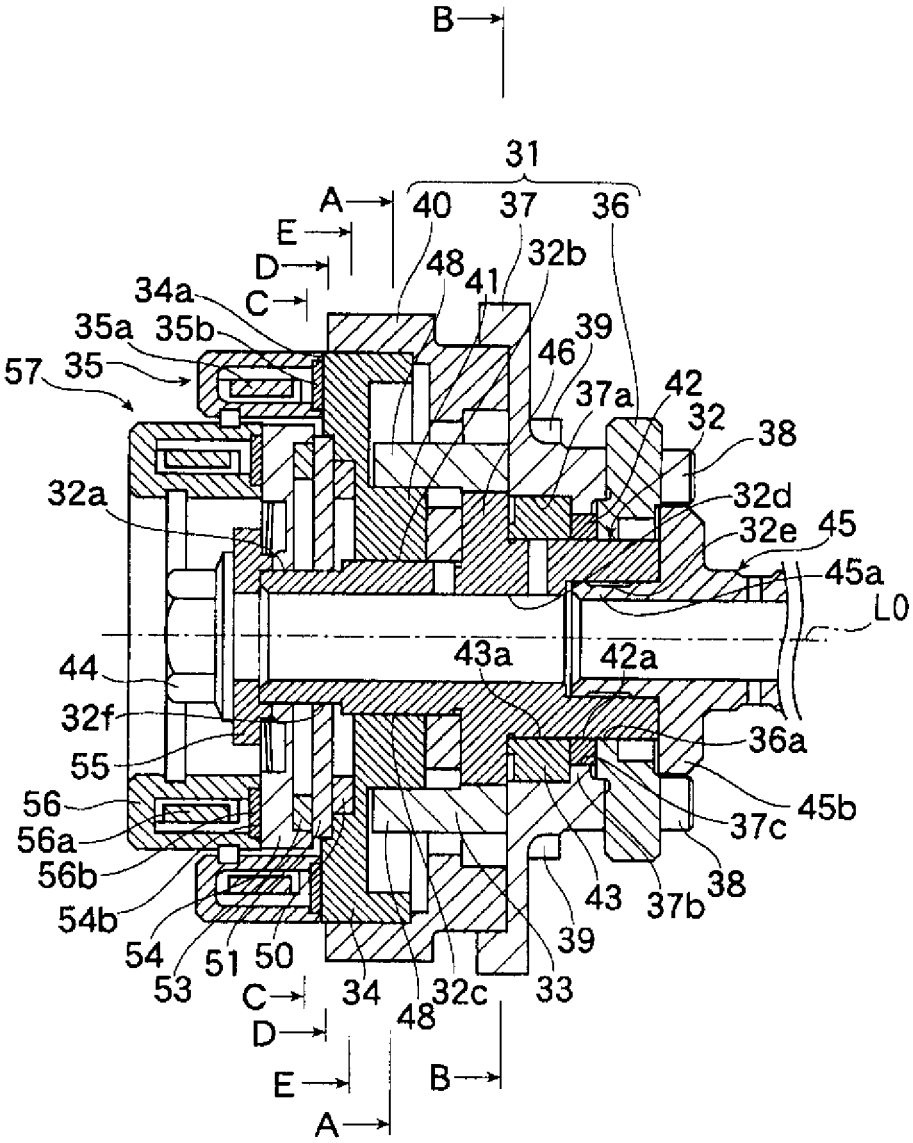
FIG. 3 is an axial cross section of the device shown in FIG. 1.

Arranged at the leading end of the small cylinder 32*a* of the 32 projecting from the circular hole 54*a* is a holder 55. As shown in FIG. 2, except for the center shaft 32, all the elements between the holder 55 and the sprocket 36 inclusive are fixedly mounted on the camshaft 45 by means of a bolt 44, which is passed through the central holes of the respective elements from front and then tightened (FIG. 3).

The second electromagnetic clutch 56 is mounted on the engine casing (not shown), facing the front end of the second control rotor 54. When the coil 56*a* of the second electromagnetic clutch 56 is energized, the clutch 56 attracts the contact face 54*b* of the second control rotor 54 and brings it into contact with the friction member 56*b*, thereby putting a brake on the second control rotor 54.

Incidentally, the movable member 52 may be equipped with bearings, or may be replaced by balls. In that case, since the movable member 52 can roll in the radial grooves 51*b* in the radial direction with less friction, energy consumption by the electromagnetic clutches 35 and 56 will be reduced. The intermediate rotor 51 is preferably formed of a non-magnetic material. If the intermediate rotor 51 is made of a non-magnetic material, the magnetic force for attracting one of the control rotors 34 and 54 is not transmitted to the other one, so that it is possible to avoid a problem that both of the first and second control rotors 34 and 54, respectively, will be simultaneously attracted by one electromagnetic clutch.

Next, referring to FIGS. 2 through 7, operations of the phase varying device 30 in accordance with the first embodiment will now be described. Under the braking action of the first electromagnetic clutch 35, the first control rotor 34 is retarded in rotation, that is, rotated in the counter clockwise direction D2, relative to the drive rotor 31, center shaft 32 and cam guide member 33.

The first circular eccentric cam 41 shown in FIG. 4(*a*) undergoes an eccentric rotation together with the first control rotor 34 in the counterclockwise direction D2 about the rotational axis L0. The grip sections 48 of the cam guide member 33 are displaced in the downward direction D3 in the radial grooves 47 by the first circular eccentric cam 41 which is in sliding contact with the radially inner surfaces of the grip sections. The cam guide member 33 is moved in the downward direction D3 together with the grip sections 48. Operations of the elements of the device up to this point are the same both in the phase retarding mode and phase advancing mode.

As the cam guide member 33 is moved downward in the phase retarding mode, the second circular eccentric cam 46 is acted upon by a force exerted by the wall of the oblong hole 49 which lowers simultaneously with the cam guide member 33, and is eccentrically rotated in the counterclockwise direction D2 as shown in FIG. 4(*b*). Since the center shaft 32 (or camshaft 45) is integral with the second circular eccentric cam 46, it is rotated in the direction D2 relative to the drive rotor 31. As a result, the phase angle of the camshaft 45 relative to the drive rotor 31 (or the crankshaft) is altered from the initial angular position to a new phase retarded position offset therefrom in the counterclockwise direction D2.

On the other hand, in the phase advancing mode, if the cam guide member 33 is moved downward as shown in FIG. 6(*a*), the second circular eccentric cam 46, initially set to a phase advancing position, is rotated eccentrically in the clockwise direction D1, contrary to the phase retarding mode. As a consequence, the center shaft 32 (or camshaft 45) is rotated in the direction D1 relative to the drive rotor 31. Accordingly, the phase angle of the camshaft 45 relative to the drive rotor 31 (or crankshaft) is changed from the initial angular position to a new position offset therefrom in the clockwise phase advancing direction D1.

On the other hand, to reduce the change in phase angle (that is, to bring back the angular position to a position closer to the initial angular position), the reverse mechanism 57 is enabled to rotate the first control rotor 34 in the phase advancing direction D1 relative to the drive rotor 31.

Figure 7:
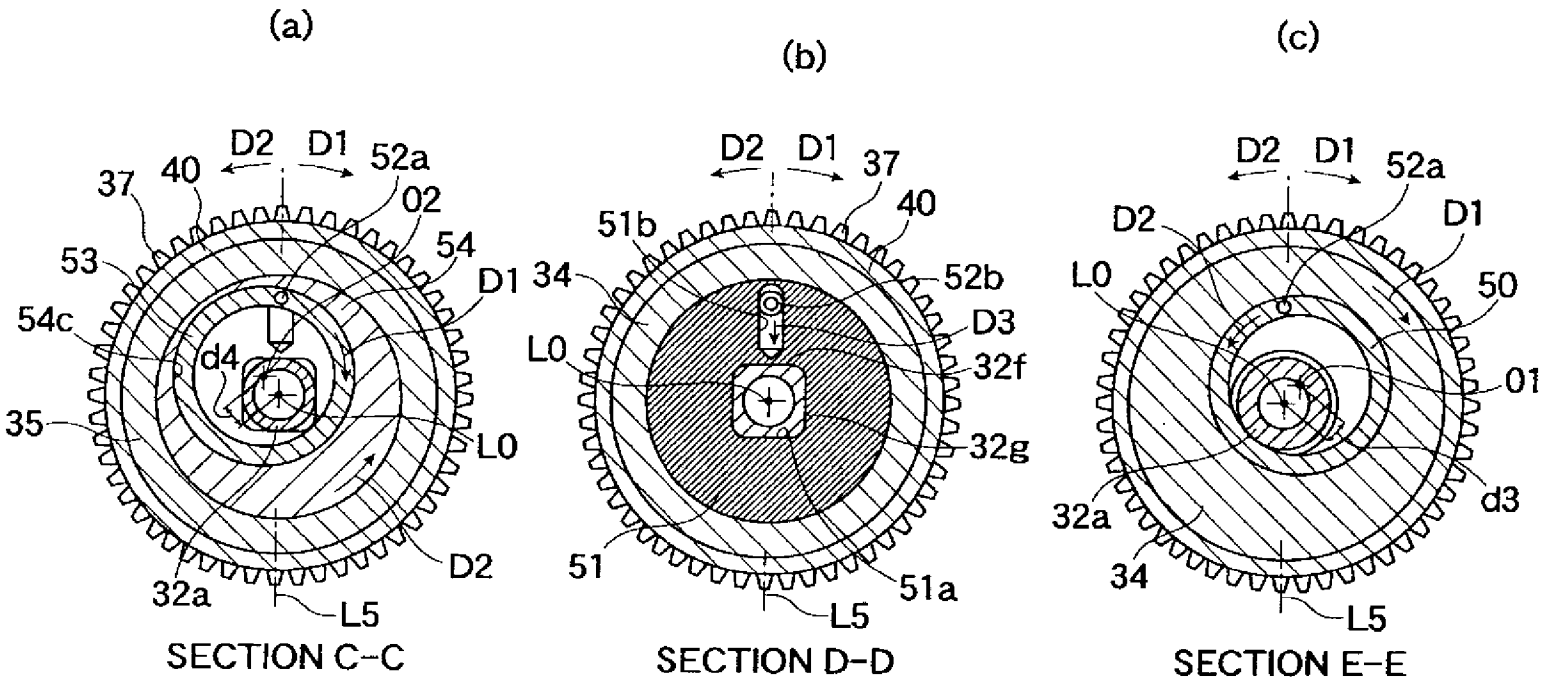
FIG. 7 shows radial cross sections of a reverse mechanism under a given initial condition. More particularly, FIG. 7(*a*) shows the cross section taken along Line C-C, FIG. 7(*b*) taken along Line D-D, FIG. 7(*c*) taken along Line E-E of FIG. 3.
Figure 8:
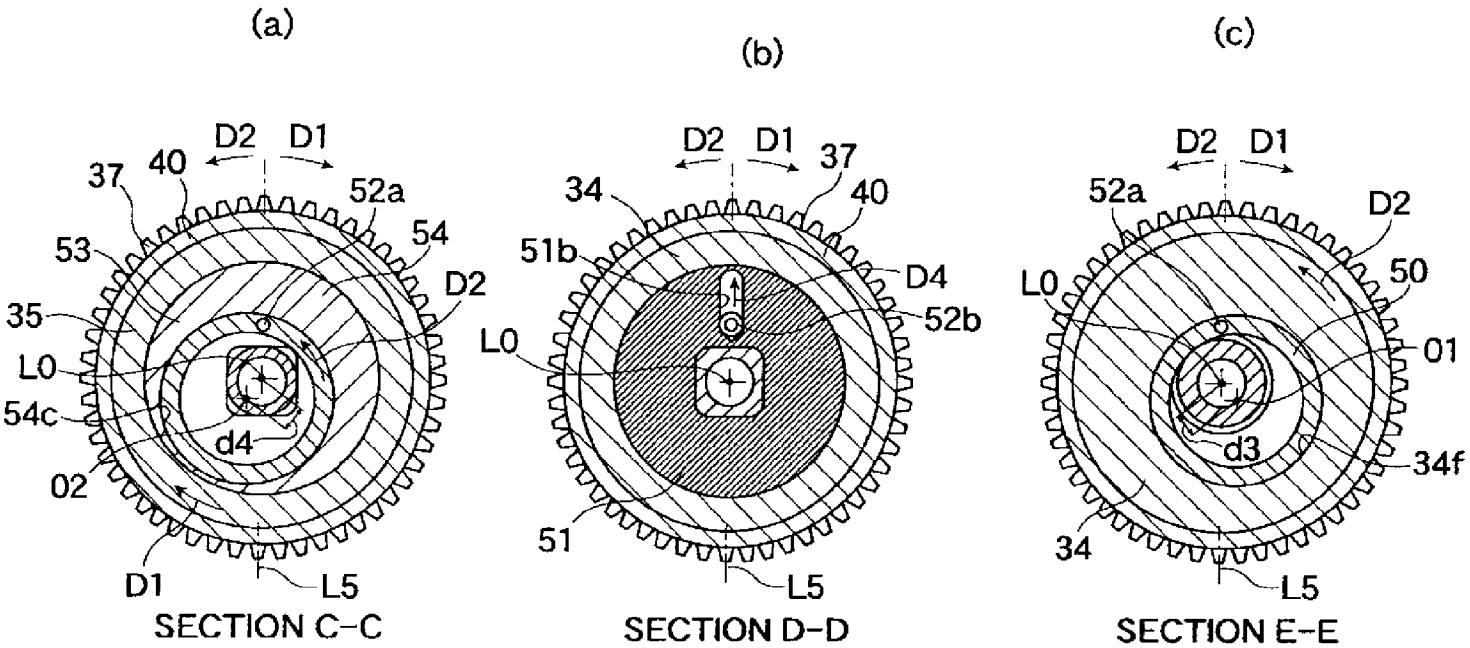
FIG. 8 shows radial cross sections of the reverse mechanism having a certain change in phase angle. More particularly, FIG. 8(*a*) shows the cross section taken along Line C-C, FIG. 8(*b*) taken along Line D-D, and FIG. 8(*c*) taken along Line E-E of FIG. 3.

Specifically, the second electromagnetic clutch 56 shown in FIG. 2 is enabled to put a brake on the second control rotor 54 shown in FIG. 7(*a*), thereby causing the second control rotor 54 to be rotated in the phase retarding direction D2 relative to the intermediate rotor 51 and first control rotor 34. The second ring member 53 then slidably rotates within the second circular eccentric bore 54*c* in the direction D1, thereby displacing the movable member 52 downward in the radial grooves 51*b* (in the direction D3 shown in FIG. 7(*b*)). As the movable member 52 is displaced in the direction D3, the first ring member 50 shown in FIG. 7(*c*) is slidably rotated in the direction D2 within the first circular eccentric hole 34*f*, generating a torque that causes the first control rotor 34 to be rotated in the direction D1. As a consequence, the first control rotor 34 is rotated in the phase advancing direction D1 relative to the intermediate rotor 51 and second control rotor 54, contrary to the case where the first electromagnetic clutch 35 is enabled.

Figure 5:
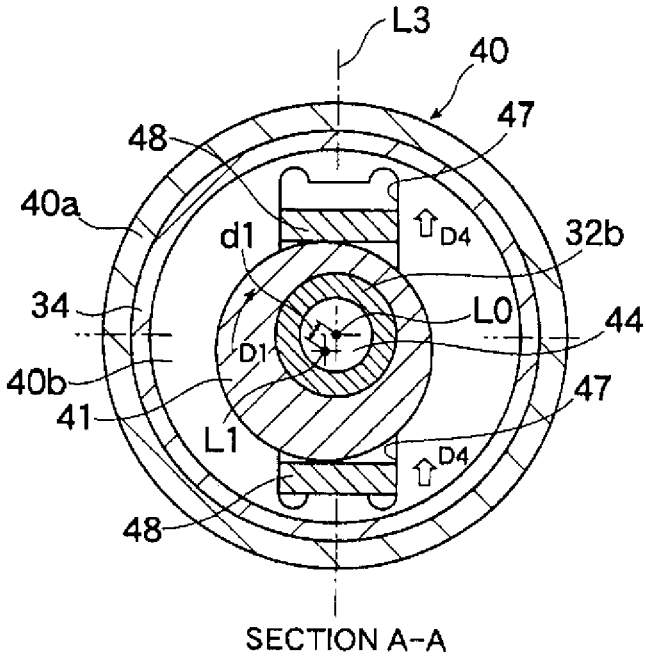
FIG. 5 shows radial cross sections of the phase varying device in accordance with the first embodiment of the invention having an altered phase angle. In particular, FIG. 5(*a*) shows the cross section taken along Line A-A of FIG. 3, and FIG. 5(*b*) the cross section taken along Line B-B of FIG. 3.
Figure 5:
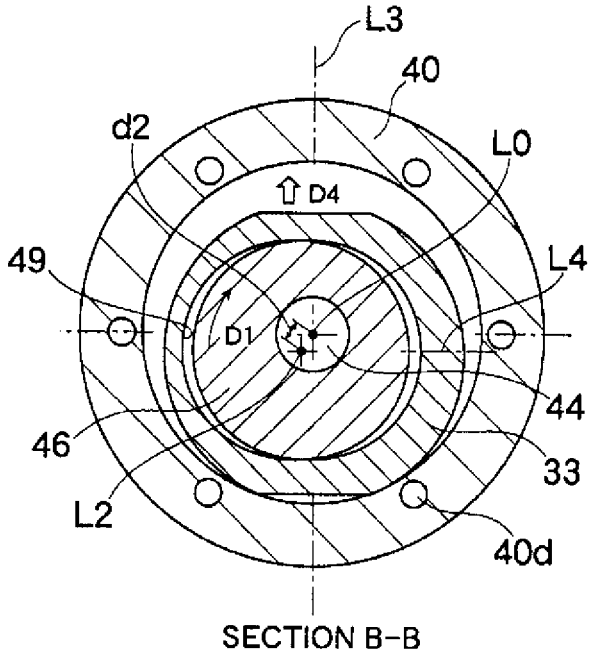

As the first control rotor 34 rotates in the phase advancing direction D1 relative to the drive rotor 31, the first circular eccentric cam 41 is eccentrically rotated in the clockwise direction D1 about the rotational axis L0 as shown in FIG. 5(*a*), thereby moving the grip sections 48 and cam guide member 33 in the upward direction D4 in the radial grooves 47. In the phase retarding mode, the second circular eccentric cam 46 (center shaft 32) shown in FIG. 5 is rotated in the phase advancing direction D1 relative to the drive rotor 31 as the cam guide member 33 moves upward. As a consequence, the crankshaft is returned relative to the drive rotor 31 towards its initial angular position, reducing its phase angle relative to the drive rotor 31. On the other hand, in the phase retarding mode, the second circular eccentric cam 46 (or center shaft 32) is rotated in the phase retarding direction D2 relative to the drive rotor 31 as the cam guide member 33 moves upward, as shown in FIG. 6(*b*). As a consequence, the phase angle of the crankshaft relative to the drive rotor 31 is reduced, that is, the crankshaft is returned towards its initial angular position.

Figure 9:
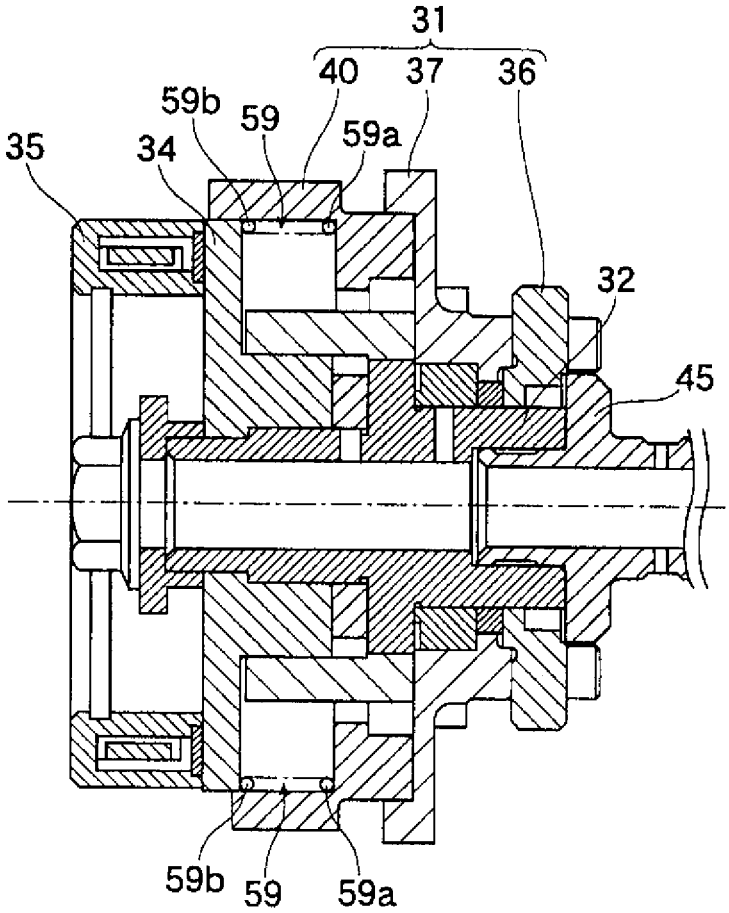
FIG. 9 is an axial cross section of a phase varying device for automobile engine in accordance with a second embodiment of the invention, having another reverse mechanism.

Referring to FIG. 9, there is shown a phase varying device in accordance with a second embodiment of the invention. The phase varying device of the second embodiment has the same structure as the first embodiment except that the reverse mechanism 57 of the first is replaced with a torsion coil spring 59 in the second embodiment.

Thus, the reverse mechanism is simple in structure. The torsion coil spring 59 has one end 59*a* securely fixed to the drive cylinder 40 and the other end 59*b* fixed to the first control rotor 34. The first control rotor 34 constantly urges the first control rotor 34 in the direction D1 opposite to the rotational direction (phase retarding direction D2 in FIG. 2) of the braking torque exerted by the first electromagnetic clutch 34.

The first control rotor 34, which rotates together with the drive cylinder 40, is rotated in the phase retarding direction D2 relative to the drive cylinder 40 if it is subjected to a braking torque exerted by the first electromagnetic clutch 35 that exceeds the urging toque exerted by the torsion coil spring 59, thereby changing the phase angle of the center shaft 32 (camshaft 45) in a predetermined direction (either in the phase advancing direction D1 or phase retarding direction D2) relative to the drive rotor 31. The rotational motion of the first control rotor 34 relative to the drive cylinder 40 is stopped at a position (referred to as balancing position of the first control rotor 34) where the urging torque of the torsion coil spring 59 acting on the first control rotor 34 balances out the braking torque of the first electromagnetic clutch 35. Since the phase angle of the camshaft 45 relative to the drive rotor 31 is determined by the balancing position of the first control rotor 34, the phase angle can be adjusted by controlling the amount of electricity supplied to the first electromagnetic clutch 35.

On the other hand, if the first electromagnetic clutch 35 is disabled, the first control rotor 34 is rotated in the phase advancing direction D1 relative to the drive cylinder 40 until it returns to its initial angular position by the urging torque of the torsion coil spring 59.

Incidentally, the camshaft 45, which is in rotation together with the crankshaft (not shown), is periodically subjected to reactive forces of the valve springs (not shown). Such reactive forces generate torques (hereinafter referred to as external disturbing torques) that cause the camshaft 45 to be rotated in either the phase advancing direction D1 or the phase retarding direction D2 relative to the drive rotor 31. Any of these external disturbing torques can arise an unexpected change in relative phase angle between the drive rotor 31 and camshaft 45.

It should be appreciated that the phase varying devices in accordance with the first and second embodiments have a self locking mechanism for preventing such unexpected phase change caused by an external disturbing torque in that the camshaft 45 is rendered inoperative or locked relative to the drive rotor 31 when subjected to an external disturbing torque.

The self locking mechanism will now be described in detail below. An external disturbing torque exerted by the valve springs on the camshaft 45 is transmitted to the second circular eccentric cam 46 as an eccentric torque acting on the cam 46. As the second circular eccentric cam 46 in the oblong hole 49 is subjected to such torque, the cam guide member 33 is acted upon by a force in the direction along the extension line L3, since the grip sections 48 are guided by the radial guide grooves 47 of the drive cylinder 40. The first circular eccentric cam 41 integral with the first control rotor 34 is acted upon by a force exerted by the grip sections 48 in the direction of the extension line L3 passing through the rotational axis L0 at a right angle.

As a consequence, when an external disturbing torque acts on the camshaft 45, the first control rotor 34 is acted upon by a force in the direction perpendicular to the rotational axis L0, so that the outer circumferential surface 34*a* of the first control rotor 34 comes into frictional contact with the inner circumferential surface 40*e* of the drive cylinder 40, thereby generating a frictional force that renders the first control rotor 34 unrotatable, or self-locked, relative to the drive cylinder 40.

If the first control cylinder 34 and drive cylinder 40 are unrotatably locked to each other, the first circular eccentric cam 41, cam guide member 33, and second circular eccentric cam 46 become altogether unrotatable or locked, thereby preventing a further change in the phase angle between the camshaft 45 and the drive rotor 31.

For this reason, it is preferable to provide a certain clearance between the outer circumferential surfaces of the middle cylinder 32*b* of the center shaft 32 and the inner circumferential surfaces of the circular holes 34*b* and 40*c* of the first control rotor 34 and drive cylinder 40, respectively. Otherwise, in the event where such self-locking should takes place, the inner circumferential surface of the circular hole 34*b* of the first control cylinder 34 comes into contact with the outer circumferential surface of the middle cylinder 32*b* and is subjected to a rotational force (torque) that acts on the center shaft 32 before the outer circumferential surface 34*a* comes into touch with the inner circumferential surface 40*e* of the cylinder. Such torque will weaken the local frictional force generated by the outer circumferential surface 34*a* of the first control rotor 34. To avoid this, a certain clearance is favored between the outer circumferential surface of the middle cylinder 32*b* and the respective inner circumferential surfaces of the circular holes 34*b* and 40*c*.

Figure 10:
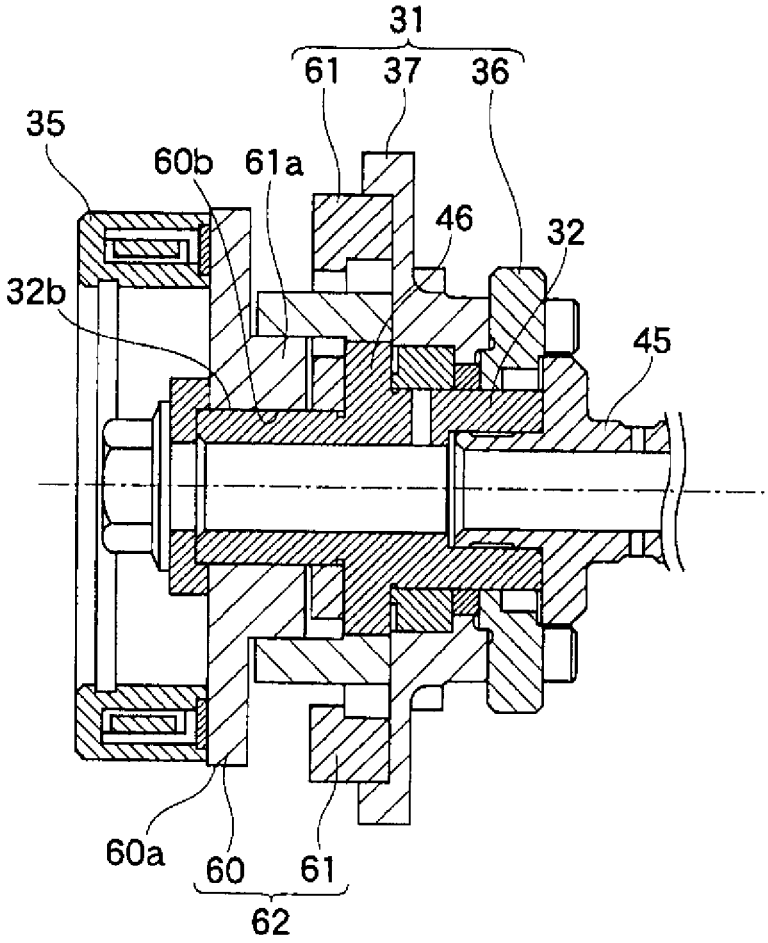
FIG. 10 is an axial cross section of a phase varying device for automobile engine in accordance with a third embodiment of the invention, having a further reverse mechanism.

Referring to FIG. 10, there is shown a phase varying device in accordance with a third embodiment of the invention. This phase varying device is the same in structure as the second embodiment, except that the first control rotor 34 and the drive rotor 40 of the second embodiment shown in FIG. 9 are replaced by a control rotor 60 having a different configuration than that of the first control rotor 34 and a drive disc 61, and that the torsion coil spring 59 is removed in the third embodiment. The phase varying device of the third embodiment has a reverse mechanism 62 which consist of the control rotor 60 and the drive disc 61. The control rotor 60 is rotatably mounted on the middle cylinder 32*b* of the center shaft 32 inserted in the circular hole 60*b*. The drive disc 61 is obtained from the drive cylinder 40 by removing the cylinder 40*b*. The reverse mechanism 62 is adapted to rotate the control rotor 60 in the direction D2 relative to the drive rotor 31 as shown in FIG. 2 by utilizing an external disturbing torque exerted on the camshaft 45. In operation, the reverse mechanism functions as follows.

The drive disc 61 has the same shape as the drive cylinder 40 shown in FIG. 9 with the cylinder 40*b* removed therefrom. The drive disc 61 does not have such an inner circumferential surface as the inner circumferential surface 40*e* for supporting the outer circumferential surface 34*a* of the control rotor 34 of the second embodiment. As a consequence, the control rotor 60 is rotatably supported by the middle cylinder 32*b* of the center shaft 32 inserted in the central circular hole 60*b*.

It is noted that a self-locking mechanism is not provided between the first control rotor 34 and drive disc 61. Now that the drive disc 61 does not have an inner circumferential surface like the inner circumferential surface 40*e* of the first embodiment on which the control rotor 60 can abut, no self-lock function takes place on the outer circumferential surface 60*a* of the control rotor 60 if an external disturbing torque is applied to the camshaft 45. As a consequence, the control rotor 60 is subjected to torques that arise from external disturbing torques and act on the camshaft 45. These torques (referred to as relative rotational torques) tend to rotate the control rotor 60 relative to the drive disc 61.

Since the relative rotation torques externally transmitted from valve springs (not shown) appear to pulsate on the camshaft 45 in synchronism with the engine rotation, they acts on the control rotor 60 both in the phase advancing direction and phase retarding direction alternately. However, the relative rotational torques are larger when they appear in the direction D1 than in the direction D2. As a consequence, upon receipt of an external disturbance from the camshaft 45, the control rotor 60 is rotated in the phase advancing direction D1 relative to the crice disc 61.

As a result, the control rotor 60 is rotated in the phase retarding direction D2 relative to the drive disc 61 if it is acted upon by a braking force of the first electromagnetic clutch 35 in excess of the external torque acting in the direction D1. If the first electromagnetic clutch 35 is disabled, the control rotor 60 undergoes a relative rotation in the phase advancing direction D1 by the external disturbing torques. The relative rotation of the control rotor 60 relative to the driver disc 61 will be stopped at a point where the braking torque of the first electromagnetic clutch 35 balances out the external disturbing torque. The camshaft 45 is rotated relative to the drive rotor 31 by the first electromagnetic clutch 35 in either the phase advancing direction D1 or phase retarding direction D2 to change the phase angle of the camshaft 45, and rotated by the external disturbing torque in the direction opposite to that caused by the first electromagnetic clutch 35. Thus, the phase angle of the camshaft 45 is fixed by balancing out the braking torque of the electromagnetic clutch with the external disturbing torque.

The invention claimed is:

1. A phase varying device for use with an automobile engine, comprising:

a drive rotor driven by the crankshaft of the engine;

a first control rotor rotatable relative to the drive rotor under the action of a torque means; and a phase angle varying mechanism operably coupled to the first control rotor in rotational motion relative to the first control rotor, the drive rotor and first control rotor rotatably supported by a camshaft of the phase varying apparatus, the phase varying device adapted to vary the phase angle of the camshaft relative to the crankshaft by varying the phase angle of the camshaft relative to the drive rotor, wherein the phase angle varying mechanism includes:

a first circular eccentric cam integrated with the first control rotor and having a center eccentrically offset from the rotational axis of the camshaft;

a second circular eccentric cam integrated with the camshaft and having a center eccentrically offset from the rotational axis of the camshaft;

a cam guide member for rotatably coupling the first circular eccentric cams with the second circular eccentric cam and for converting the eccentric rotational motion of the first circular eccentric cam into the eccentric rotational motion of the second circular eccentric cam, thereby varying the phase angle of the camshaft relative to the drive rotor in accord with the eccentric rotational motion of the second circular eccentric cam relative to the first circular eccentric cam.

2. The phase varying device according to claim 1, wherein the drive rotor includes radial guide grooves that extend in substantially radial directions perpendicular to the rotational axis of the camshaft; and wherein the cam guide member includes a pair of grip sections penetrating the radial guide grooves to grip the outer circumference of the first circular eccentric cam by the opposite sides, the grip sections movable in the radial guide grooves in response to the eccentric rotational motion of the first circular eccentric cam; and an oblong circular hole extending in the direction perpendicular to the radial guide grooves and slidably accommodating therein the second circular eccentric cam so as to displace the second circular eccentric cam in the direction perpendicular to the radial guide grooves.

3. The phase varying device according to claim 1 or claim 2, wherein the torque means comprises:

a first control means for rotating the first control rotor in the phase retarding direction relative to the drive rotor; and a reverse mechanism for rotating the first control rotor in the phase advancing direction relative to the drive rotor.

4. The phase varying device according to claim 3, wherein the reverse mechanism comprises:

a second control rotor rotatable relative to the camshaft;

a second brake means for putting a brake on the second control rotor so as to rotate the second control rotor in the phase retarding direction relative to the first control rotor; and a ring mechanism for rotating the first control rotor in the phase advancing direction relative to the drive rotor when the second braking means is in operation, and wherein the ring mechanism includes:

a first ring member in sliding contact with a first circular eccentric hole formed in the first control rotor;

a second ring member in sliding contact with a second circular eccentric hole formed in the second control rotor;

an intermediate rotor having a radial guide groove and being rotatable together with the camshaft; and an eccentric coupling member passing through the radial guide groove of the intermediate rotor and movable in the radial guide groove, the eccentric coupling member having opposite ends rotatably coupled to the first and second ring members, respectively, to allow for relative eccentric rotations of the first and second ring members.

* * * * *

UNITED STATES PATENT AND TRADEMARK OFFICE

CERTIFICATE OF CORRECTION

PATENT NO. : 8,522,736 B2
APPLICATION NO. : 13/255728
DATED : September 3, 2013
INVENTOR(S) : Masaaki Niiro It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 88 days.

Signed and Sealed this
Fifteenth Day of September, 2015

Michelle K. Lee

Michelle K. Lee
*Director of the United States Patent and Trademark Office*